US009190037B2

(12) United States Patent
May

(10) Patent No.: US 9,190,037 B2
(45) Date of Patent: Nov. 17, 2015

(54) DRUM DAMPING MODIFICATION DEVICE

(71) Applicant: James H. May, Valencia, CA (US)

(72) Inventor: James H. May, Valencia, CA (US)

(73) Assignee: REMO, INC., Valencia, CA (US)

( * ) Notice: Subject to any disclaimer, the term of this patent is extended or adjusted under 35 U.S.C. 154(b) by 85 days.

(21) Appl. No.: 13/999,440

(22) Filed: Feb. 26, 2014

(65) Prior Publication Data

US 2015/0243266 A1 Aug. 27, 2015

(51) Int. Cl.
*G10D 13/02* (2006.01)

(52) U.S. Cl.
CPC ..... *G10D 13/022* (2013.01)

(58) Field of Classification Search
CPC ... G10D 13/026; G10D 13/02; G10D 13/021; G10D 13/027; G10D 13/028; G10D 13/023
USPC ..... 84/411 R, 421
See application file for complete search history.

(56) References Cited

U.S. PATENT DOCUMENTS 4,567,807 A * 2/1986 Robinson ..... 84/411 M
4,589,323 A 5/1986 Belli
5,159,139 A * 10/1992 Beals et al. ..... 84/414

* cited by examiner

*Primary Examiner* — Kimberly Lockett
(74) *Attorney, Agent, or Firm* — Larry F. Gitlin, Esq.; Beaumont, Gitlin, Tashjian

(57) ABSTRACT

A sound dampening modification means for a musical drum comprising, in combination with a drumshell, a drumhead with a playing surface and a rim, and a drumhead fastening means with a bottom edge, an annular base, and a means joined integral with the annular base to mount the annular base upon the drumhead rim. The means to mount the annular base upon the drumhead rim is positioned so that it may be suspended above the playing surface and held there between the bottom edge of the drumhead fastening means and the drumhead rim. Also provided is a means to muffle drumhead sounds comprised of sound absorbing material positioned between the drumhead fastening means and the drumhead rim.

12 Claims, 10 Drawing Sheets

DRUM DAMPING MODIFICATION DEVICE

BACKGROUND OF THE INVENTION

1. Field of the Invention

The present invention relates generally to the field of musical instruments and, more particularly, to a drum dampening modification device which is removably mounted above or in conjunction with a drumhead.

2. Description of the Prior Art

Devices for use in dampening sounds produced by percussion instruments, particularly musical drums, are well known in the art. Examples include, by way of example only, plastic or rubber rings (e.g. a Mylar® disc) placed upon or beneath a drumhead and/or using a pillow or some type of cloth material placed inside the shell of a bass drum. The objective in all these cases is threefold. The first is to reduce the sound of the drum or dampen high frequencies, i.e., make it less noisy and obtrusive by employing some type of sound absorbing material. The second is to reduce drum overtones. And the third is to preserve the authentic or "full" drum sound while still altering the drums overtones.

One example of a device in the prior art that achieves all three objections, though by different means, is disclosed in U.S. Pat. No. 4,589,323, which teaches the use of a device that acts as a support for some type of sound altering or muffling material, e.g. foam or some other suitable type of sound absorbing material, placed between the lower-positioned support device and the batter head in contact with the latter. When the drumhead is struck by a hard object, like a drumstick, the sound absorbing material acts to reduce the overall sound of the drum while at the same time eliminating much, if not most, of the overtones. However, the serious drawback with this device requires the removal of the drum counterhoop, which acts to hold the support device, the sound absorbing material and the drumhead in place, then the drumhead to enable the removal of the sound absorbing material underneath in order to replace it. To substitute one sound absorbing material with another to achieve different sound objectives always requires the removal of the drumhead. This is unduly burdensome and extremely time consuming.

Thus, until now, nothing in the prior art provides for an uncomplicated device or method for easily and quickly replacing or substituting sound absorbing or dampening materials, which modify the dampening of sounds and/or to control overtones of a musical drum, without the need to first remove the drumhead.

SUMMARY OF THE INVENTION

The present invention provides a sound dampening modification means for a musical drum comprising, in combination with a drumshell, a drumhead with a playing surface and a rim, and a drumhead fastening means with a bottom edge, an annular support member and a means joined integral with the annular support member to mount the annular support member upon the drumhead rim. The means to mount the annular support member upon the drumhead rim is positioned so that it may be suspended above the playing surface and held there between the bottom edge of the drumhead fastening means and the drumhead rim. Also provided is a means to muffle drumhead sounds consisting of sound absorbing material positioned between the drumhead fastening means and the drumhead rim.

Accordingly, it is an object of the present invention to provide a device for dampening the sound of a drum.

It is another object of the present invention to provide a device that can modify the dampening of the sound of a drum.

It is another object of the present invention to provide a device that also controls drum overtones.

It is another object of the present invention to provide a device that is uncomplicated in structure and arrangement to enable the easy and quick replacement or substitution of sound dampening materials without the need to first remove the drumhead.

It is another object of the present invention to provide a device that, when employed, does not vary the authentic feel of a drumhead when struck by drumsticks or some other type of hard object used to produce drum sounds.

It is another object of the present invention to provide a device that is cost effective to use and manufacture.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 2:
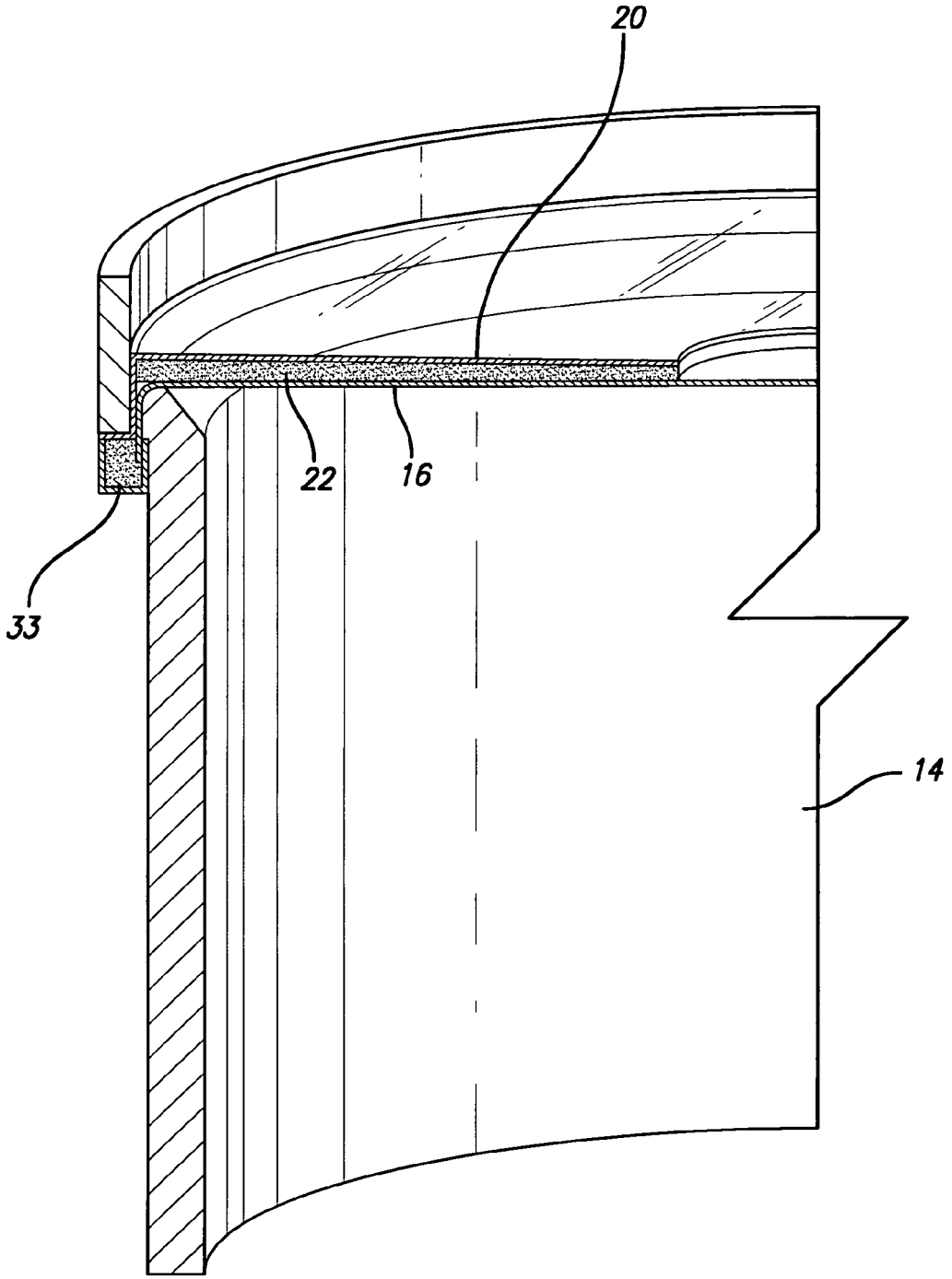
FIG. 2 is a cross-sectional view of the device of the present invention, taken along line 2-2 of FIG. 1.
Figure 3:
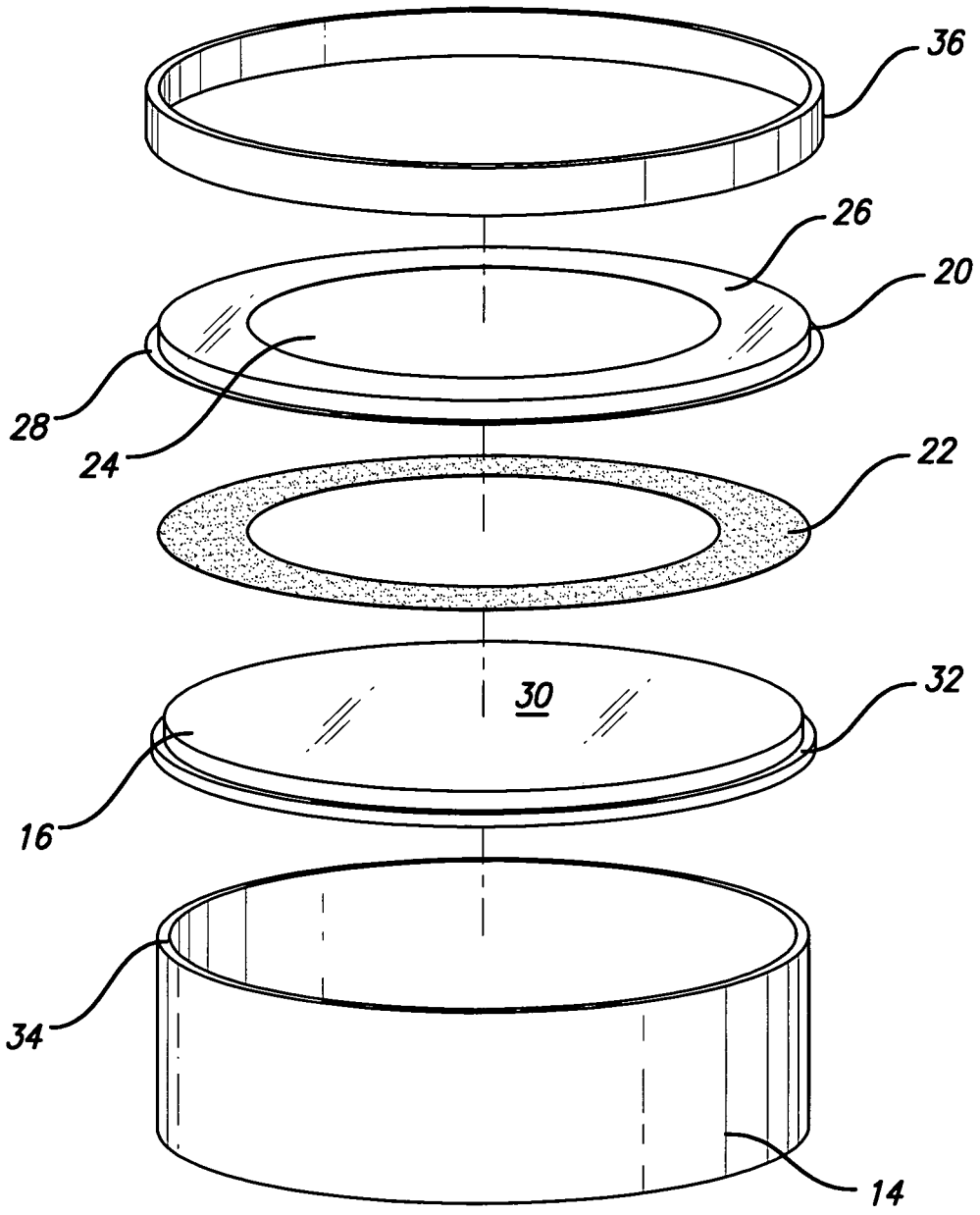
FIG. 3 is an exploded view of the device of the present invention shown in combination with an example of sound absorbing material positioned between the support member and the drumhead.

The present invention will be described in more detail with reference to the preferred embodiment shown in FIGS. 1 through 3.

Figure 1:
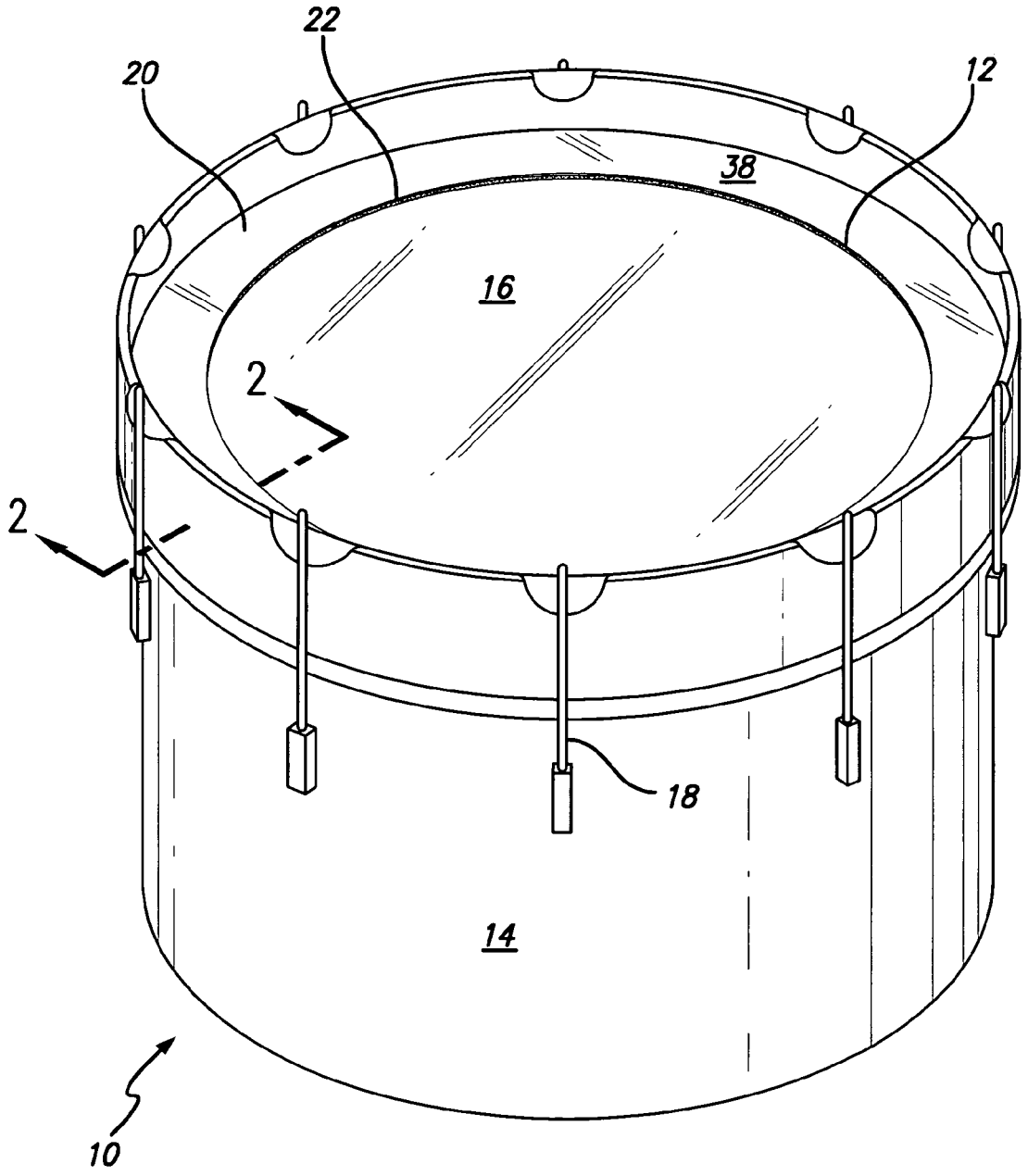
FIG. 1 is a perspective view of the device of the present invention employed in connection with a musical drum.

FIG. 1 is a perspective view of a musical drum 10 incorporating the drum dampening modification device 12 of the present invention. Dampening modification device 12 is generally used in a musical drum 10, which includes a drumshell 14, a drumhead 16, and a plurality of fastening members 18. As shown in FIG. 3 and in cross-section in FIG. 2, dampening modification device 12 includes annular support member 20 and sound absorbing ring 22, which are caused to fit over drumhead 16 to ensure that ring 22 is held free floating in place. Annular support member 20, which may be comprised of plastic or any other suitable material, includes a generally uniform opening 24 and a concentric perimeter section 26, which normally conforms generally with the shape and dimensions of ring 22. Annular support member 20 also includes a rim 28. Drumhead 16 has a playing surface 30 integrally joined to rim 32, and a flesh hoop 33 which, in turn is mounted upon shell 14 by placing drumhead 16 over edge 34 of shell 14. To achieve the objective of the present invention, sound absorbing ring 22 is placed upon playing surface 30, as shown in FIG. 3. Annular support member 20 is then placed upon ring 22 with rim 28 then positioned upon rim 32 with ring 22 free-floating between drumhead 16 and perimeter section 26. A counterhoop 36 is then placed on top of rim 28 and secured to drumshell 14 by fastener members 18 positioned equidistant around musical drum 10. Sound absorbing ring 22 may be comprised of any type of material with good sound absorption qualities including, without limitation, foam, rubber, certain fabrics and any other suitable material. The degree of dampening may be varied by altering the material, its width or thickness, or its density.

Figure 9:
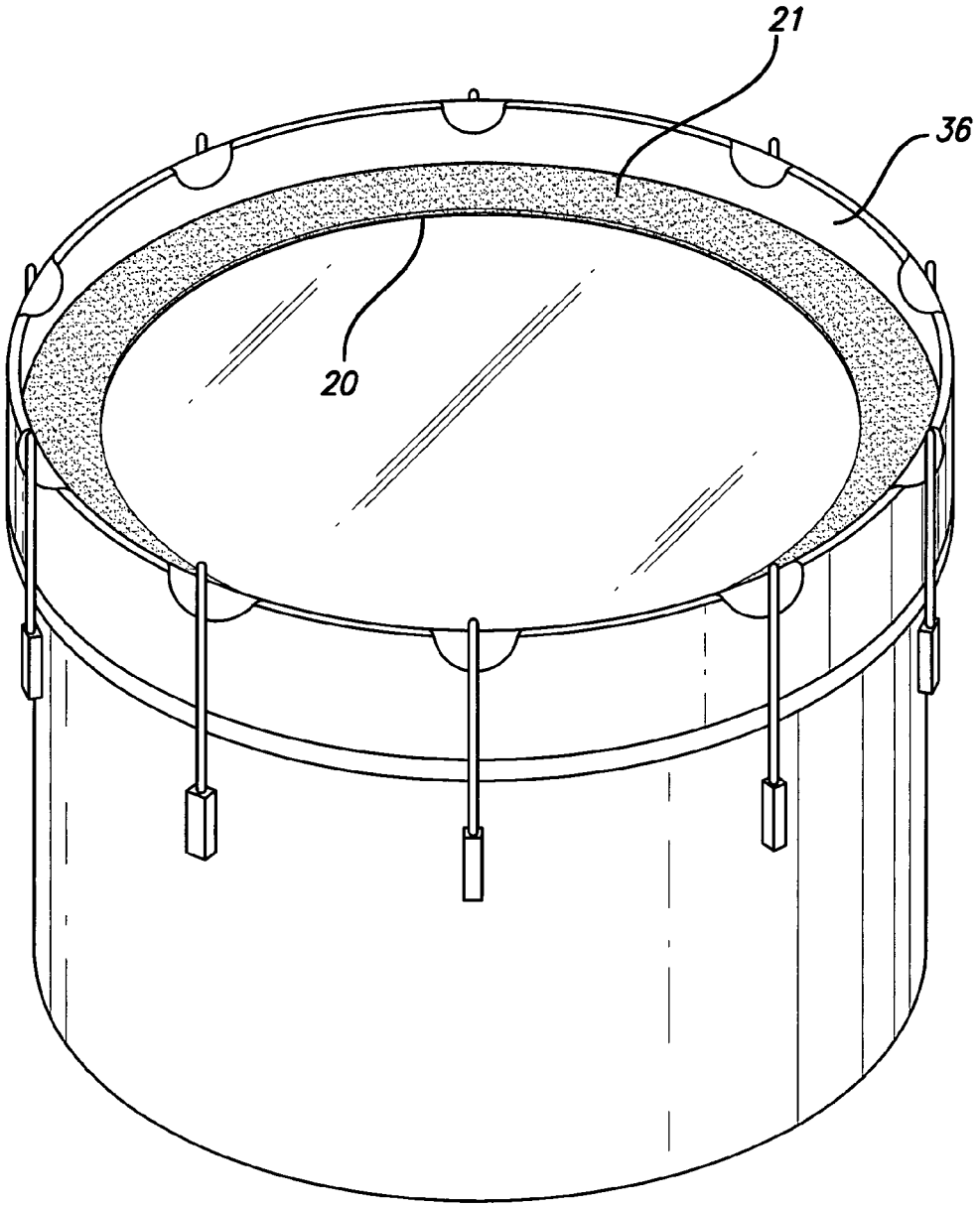
FIG. 9 is a perspective view of an alternative embodiment of the device of the present invention.

When it becomes necessary to replace ring 22 for any reason, it is easily done by simply disconnecting and removing counterhoop 36 and then annular support member 20 to give access to enable the removal and/or substitution of ring 22. A new ring 22 is then provided and annular support member 20 and counterhoop 36 are installed in reverse sequence and secured. Annular support member 20 may be used to accommodate other types of sound absorbing materials upon its top surface 38, wherein the additional sound absorbing materials 21 would be constrained by counterhoop 36 as shown in FIG. 9. These additional sound absorbing materials would further alter the character of the drum sounds when combined with ring 22.

Figure 4:
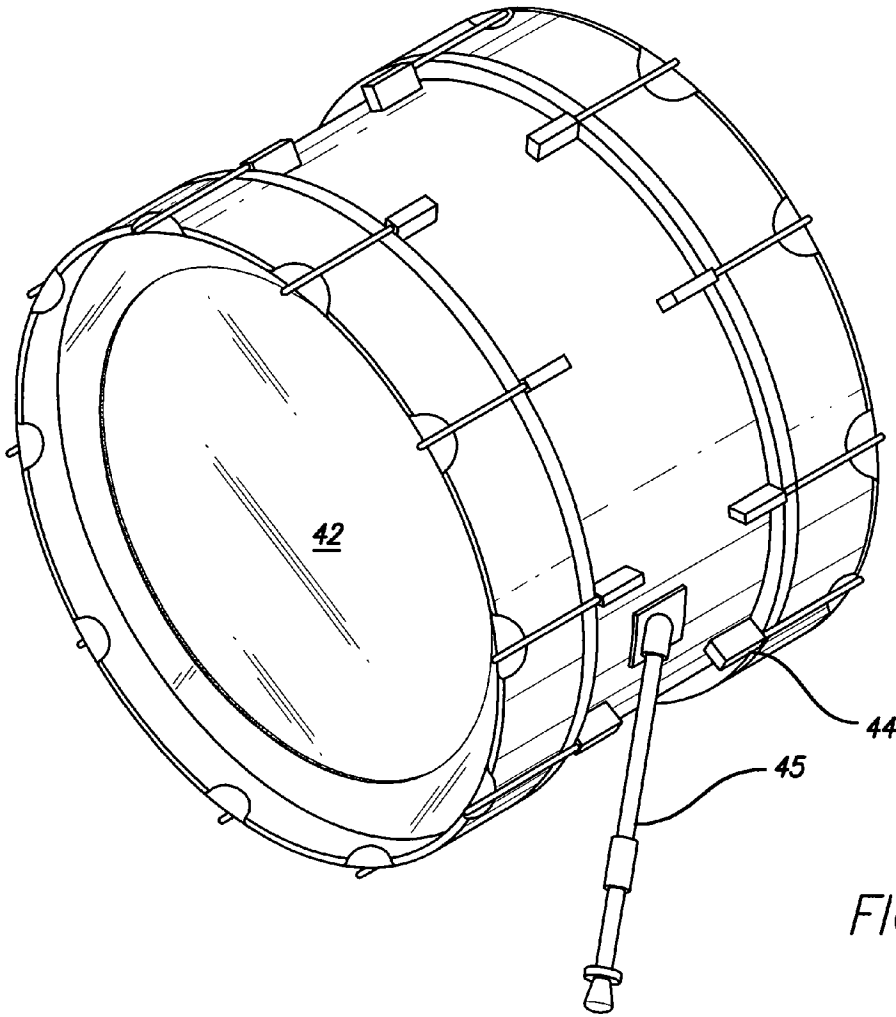
FIG. 4 is a perspective view of the device of the present invention shown employed in combination with the resonant head of a bass drum.
Figure 5:
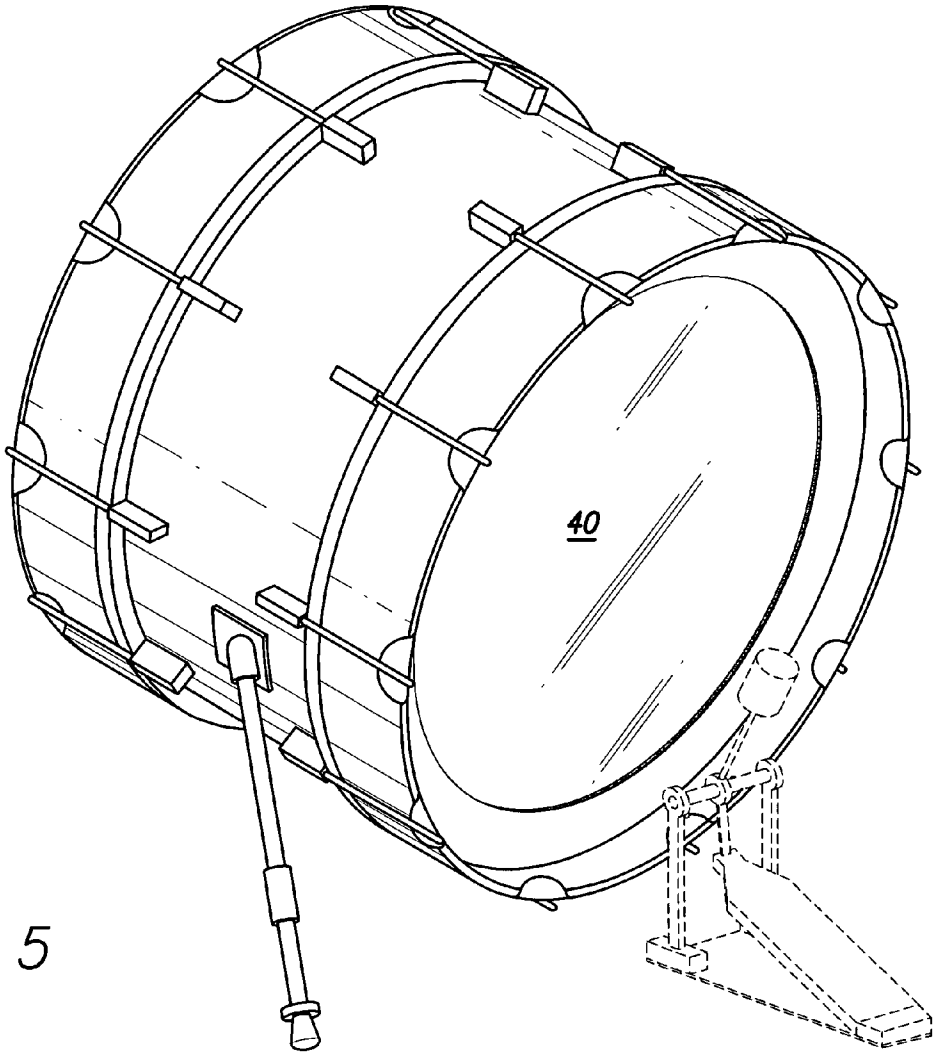
FIG. 5 is a perspective view of the device of the present invention shown employed in combination with the batter head of a bass drum.
Figure 6A:
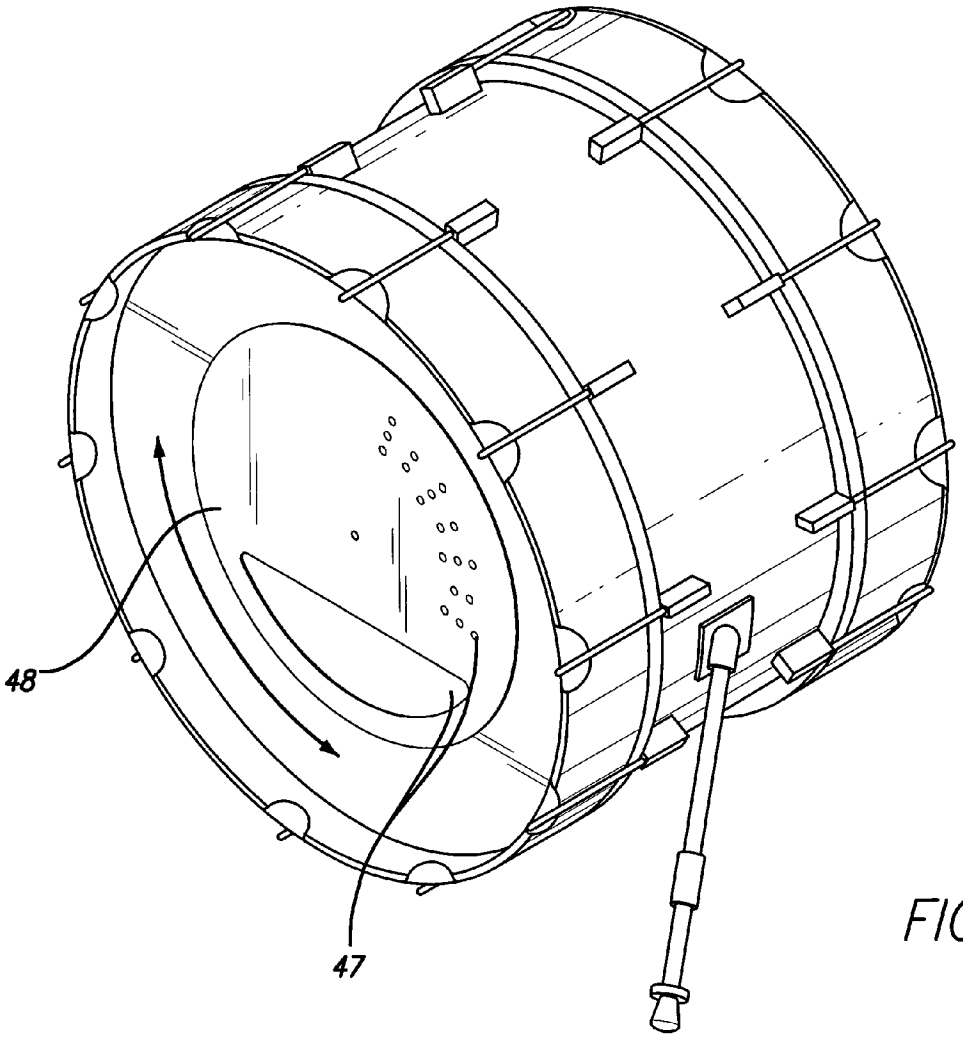
FIG. 6A is a perspective view of an alternative embodiment of the present invention shown in combination with a rotatable dial for regulating the airflow emanating from the drum.
Figure 6B:
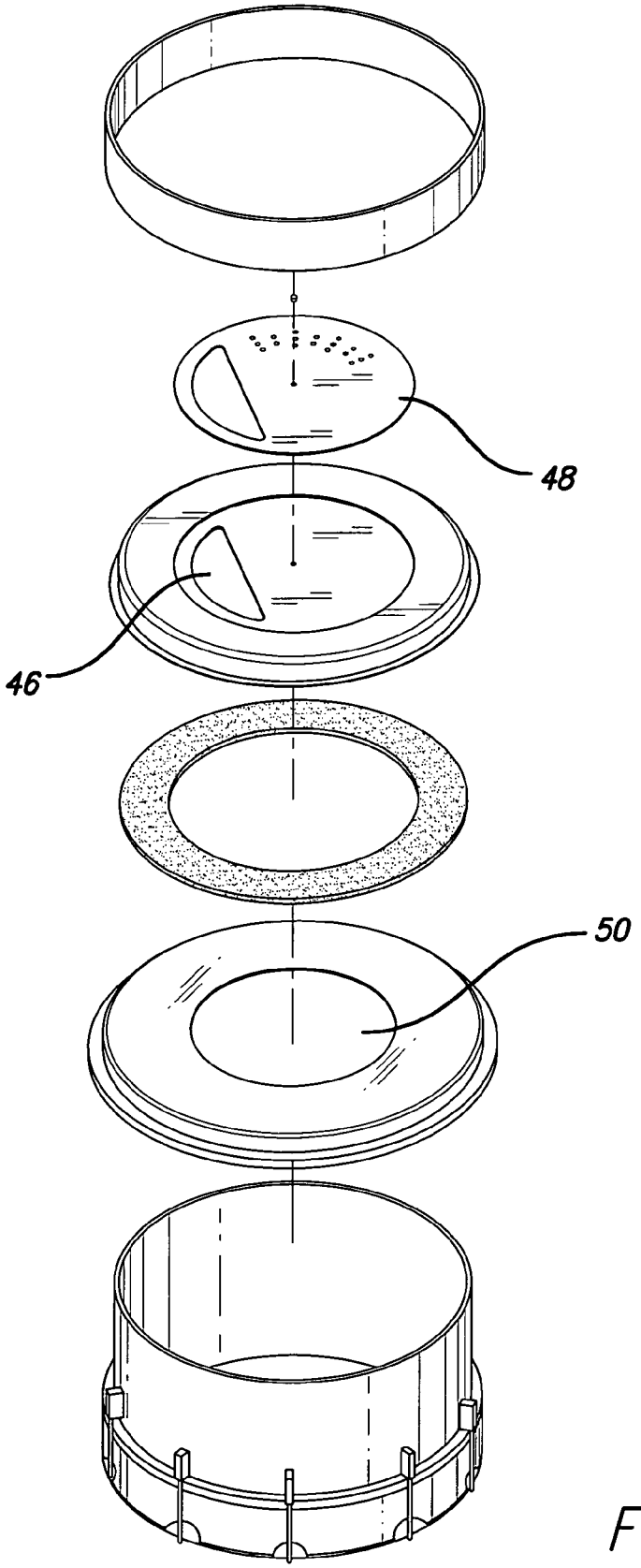
FIG. 6B is an exploded view of the device of the present invention shown with a vented support member in combination with a rotatable dial for adjusting airflow emanating from inside the shell through a ported head.
Figure 7A:
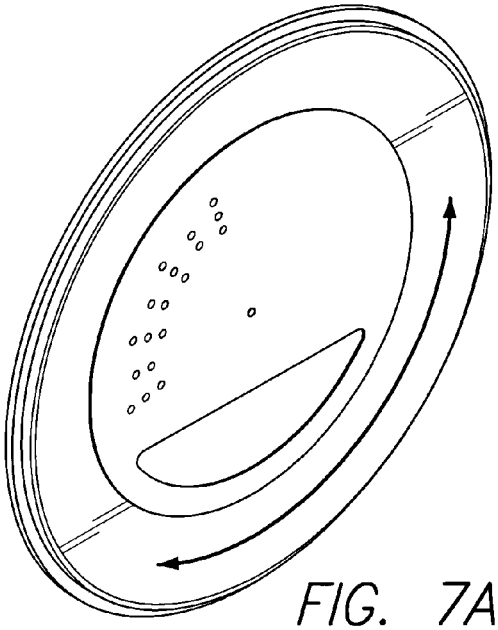
FIGS. 7A-7C are various embodiments of the annular support member utilized in combination with the device of the present invention with a rotatable dial and examples of various vent configurations.
Figure 7B:
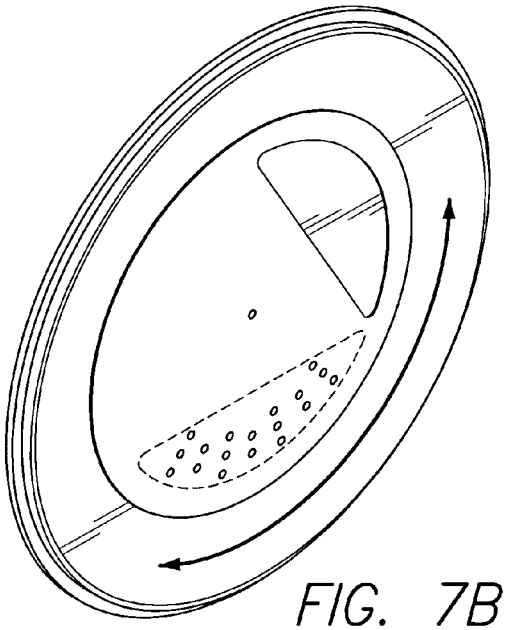
Figure 7C:
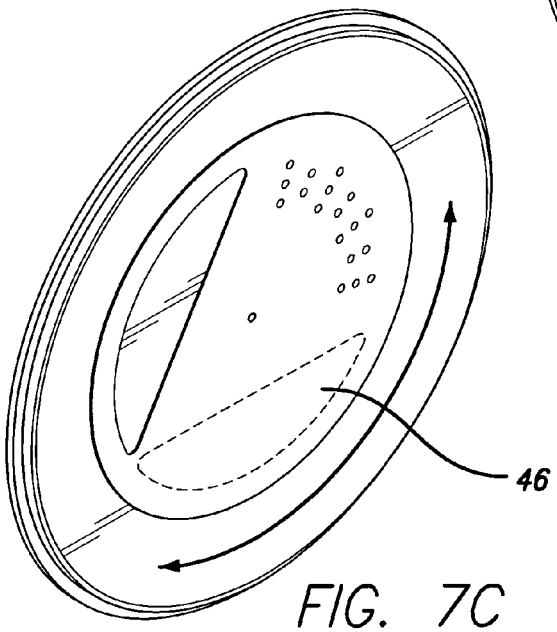
Figure 8:
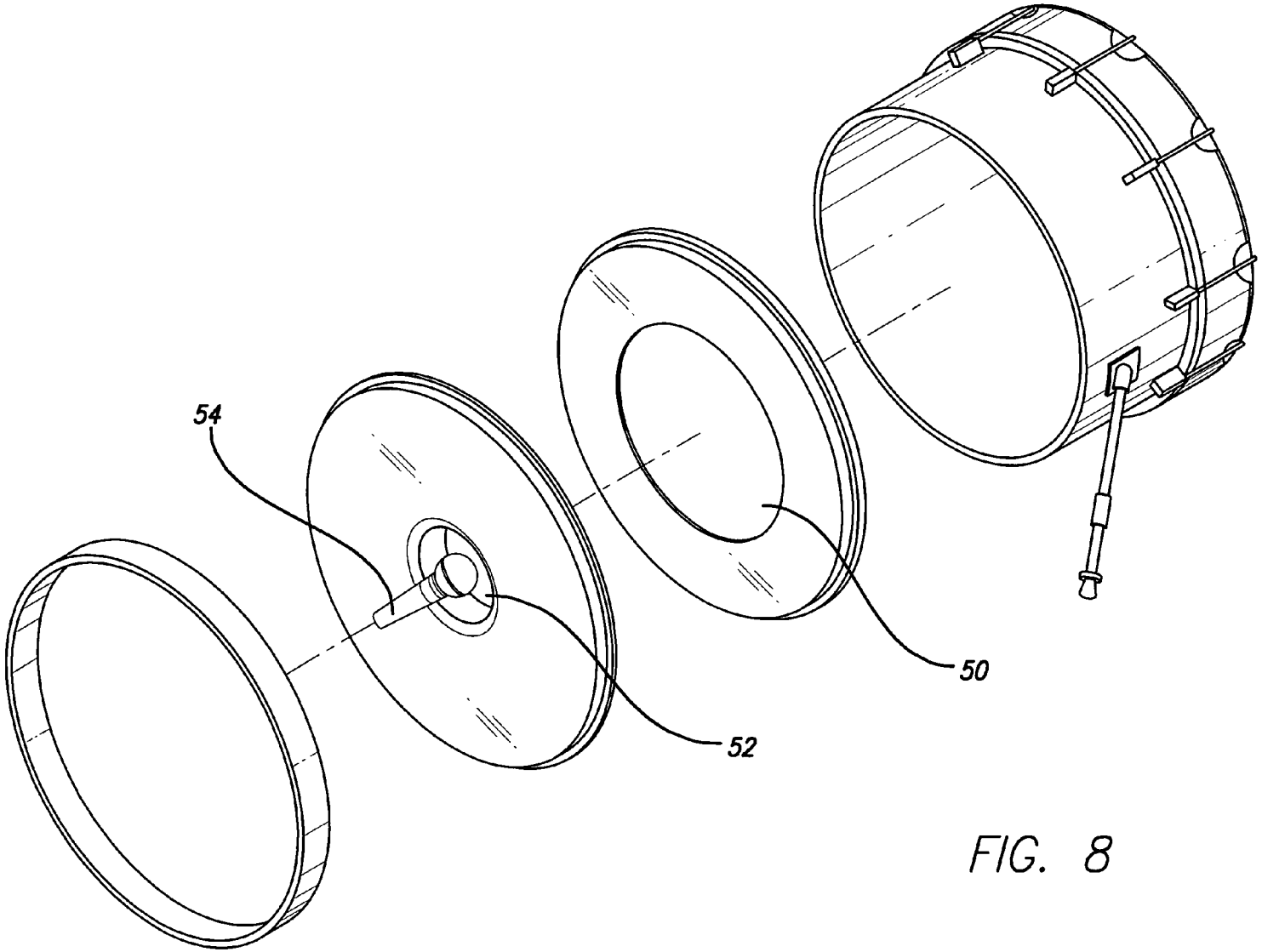
FIG. 8 is an exploded view of an alternative embodiment of the device of the present invention.

An alternative embodiment of the present invention includes the use of annular support member 20 in combination with batter head 40 and resonant head 42 of bass drum 44 (with leg 45), as shown in FIGS. 4 and 5, with ring 22 positioned as heretofore described.

Another alternative embodiment of the present invention utilizes a closed resonant head 42 and annular support member 20 with one or more apertures 46 and a dial member 48 affixed in any conventional manner to annular support member 20. This enables the variable rotation of dial member 48, which includes apertures 47, for opening or closing aperture 46 by adjusting the alignment between apertures 46 and 47 to regulate airflow directed from inside musical drum 10 when batter head 40 is struck. Adjusting the airflow in this manner alters the drum sounds by regulating the overtones.

Another embodiment of the present invention utilizes a ported resonant head 42 with aperture 50 of any appropriate size formed therein and annular support member 20 with generally conforming aperture 52 sized to accommodate microphone 54 or any other type of sound enhancing or amplification device. Microphone 54 may be mounted inside aperture 52 using any suitable adjustable mounting flange or other means for this purpose. This embodiment may be modified in several ways, including the use of resonant head 42 without an aperture.

While the invention is described in connection with a certain preferred embodiment, it is understood that it is not intended to limit the invention to that particular embodiment. Rather, it is intended to cover all alternatives, modifications and equivalents as may be included within the spirit and scope of the invention as defined by the appended claims.

The invention claimed is:

1. A sound dampening modification means for a musical drum having a drumshell, a drumhead with a playing surface and a rim, and a drumhead fastening means having a bottom edge, the sound dampening modification means comprising:

an annular support member; and a means integral with said annular support member to mount said annular support member upon said drumhead rim, said drumhead rim mounting means being adapted to position itself upon said drumhead rim so that said annular base is suspended above said playing surface, said drumhead rim mounting means being adapted to be held in place between said bottom edge of said drumhead fastening means and said drumhead rim.

2. The sound dampening modification means of claim 1 further comprising a means to muffle sound positioned between said drumhead rim mounting means and said drumhead.

3. The sound dampening modification means of claim 2 wherein said means to muffle sound comprises a sound absorbing material.

4. The sound dampening modification means of claim 3 wherein said sound absorbing material is of a non-uniform thickness.

5. The sound dampening modification means of claim 3 wherein said sound absorbing material is non-circular in shape.

6. The invention of claim 1 wherein said sound dampening modification means is capable of harmonically altering the overtones of said musical drum.

7. The sound dampening modification means of claim 3 wherein said means to muffle sound comprises foam.

8. The sound dampening modification means of claim 2 wherein said drumhead includes at least one aperture.

9. A sound dampening modification means for a musical bass drum having a drumshell, drumheads comprising a resonant head and a batter head with each said head having a surface and a rim, and a first drumhead fastening means relative to said batter head and a second drumhead fastening means relative to said resonant head, each said drumhead fastening means having a bottom edge, the sound dampening modification means comprising:

at least two annular support members; and a means integral with each said annular support member to mount one said annular support member upon said rim of said resonant head and the other said annular support member upon said rim of said batter head, said drumhead rim mounting means being adapted to be positioned upon said rims individually so that each said annular support member is spaced-apart from a corresponding said head surface, said rim mounting means being adapted to be held in place between said bottom edge of each said drumhead fastening means and each said corresponding rim.

10. The sound dampening modification means of claim 9 wherein said annular support member mounted upon said resonant head includes one or more apertures and an affixed dial member, said dial member having one or more apertures and being rotatable for enabling the opening and closure of one or more of said apertures of said annular support member to adjust airflow emanating from said musical drum when said batter head is struck.

11. The sound dampening modification means of claim 10 wherein said resonant head is ported.

12. The sound dampening modification means of claim 9 further wherein said resonant head includes at least one aperture and said annular support member mounted upon said resonant head includes at least one aperture, said apertures being substantially aligned to accommodate a microphone or some other sound enhancing or amplification devices in retained relation.

* * * * *